United States Patent [19]

Sado

[11] 4,348,557

[45] Sep. 7, 1982

[54] KEY-BOARD SWITCH UNIT

[75] Inventor: Ryoichi Sado, Saitama, Japan

[73] Assignee: Shin-Etsu Polymer Co., Ltd., Tokyo, Japan

[21] Appl. No.: 249,361

[22] Filed: Mar. 31, 1981

[30] Foreign Application Priority Data

Apr. 4, 1980 [JP] Japan ..... 55-45388[U]

[51] Int. Cl.[3] ..... H01H 13/12

[52] U.S. Cl. ..... 200/5 A; 200/159 B; 200/292

[58] Field of Search ..... 200/5 A, 159 B, 292, 200/267, 269, 158

[56] References Cited

U.S. PATENT DOCUMENTS 4,314,115 2/1982 Sado et al. ..... 200/5 A 4,317,012 2/1982 Itoh ..... 200/5 A

*Primary Examiner*—A. T. Grimley

*Assistant Examiner*—Morris Ginsburg

*Attorney, Agent, or Firm*—Hopgood, Calimafde, Kalil, Blaustein & Judlowe

[57] ABSTRACT

The invention provides a novel key-board switch unit comprising a printed circuit board having fixed contact points and fixed terminals formed thereon and a covering sheet member having patch-like flexible contacting sheet members bonded on the lower surface thereof and fastened together by means of screw bolts or the like means with a spacer sheet having openings sandwiched therebetween, each of the flexible contacting sheet members being large enough to cover at least one fixed contact point and at least one fixed terminal. Different from conventional ones, the inventive switch unit is assembled together by fastening with screw bolts penetrating the fixed terminals on the printed circuit board so that most reliable electric connection is obtained across the opening in the spacer sheet between the fixed terminal and the flexible contacting sheet member on the covering sheet member which also serves as a movable contact point with the fixed contact point on the printed circuit board.

3 Claims, 12 Drawing Figures

KEY-BOARD SWITCH UNIT

BACKGROUND OF THE INVENTION

The present invention relates to a novel and improved key-board switch unit or, more particularly, to a structure of a key-board switch unit of which the assembling work of parts can be performed very conveniently and efficiently.

As a key-board switch unit for a complicated electric circuit such as those shown by an equivalent circuit of a sequence of so-called X-Y matrix, there is known a switch unit comprising a printed circuit board provided with a plurality of fixed contact points, fixed terminals and lead-out terminals as well as wiring circuits connecting them, a spacer sheet placed on the printed circuit board and provided with openings at positions corresponding to the fixed contact points and fixed terminals on the printed circuit board and an elastically resilient and electrically insulating covering sheet member placed on the spacer sheet and provided on the surface contacted with the spacer sheet with flexible contact points facing the fixed contact points across the openings in the spacer sheet. The flexible contact points on the covering sheet member are formed, for example, by printing with an electroconductive paint or printing ink and connecting circuits between them are simultaneously formed according to the desired circuit diagram. When the printed circuit board and the covering sheet member is contacted with a fixed terminal on the printed circuit board across an opening in the spacer sheet so that any troublesome means for forming a jumping circuit on the printed circuit board can be obviated.

Key-board switch units of the above described type are advantageously used in a control or operation panel of a variety of electronic instruments taking advantages of their very small thickness and inexpensiveness by virtue of the absence of jumping circuits and through-hole circuits which cost so much in forming.

In mounting the key-board switch unit of the above described type on an electronic instrument, it is a usual practice that several screw bolts are screwed into the frame of the instrument penetrating the key-board switch unit composed of the printed circuit board, spacer sheet and covering sheet member so as that fastening of these three components and mounting of the thus integrated switch unit on the instrument can be simultaneously obtained.

A problem in fastening and mounting of the key-board switch unit in the above described manner is that, because the screw bolts usually penetrate the switch unit at positions apart from the fixed terminals, the contacting condition for making electric connection between the fixed terminal and a part of the connecting circuit on the covering sheet member is sometimes unstable and unreliable due to the distortion caused in the printed circuit board or the covering sheet member depending on the fastening force caused by screwing the screw bolts into the frame.

In order to overcome the above problem and to obtain more reliable contacting condition between the fixed terminals and the connecting circuits on the covering sheet member, there has been proposed a means in which a resilient member such as a coil spring or a rubber pad is applied separately to the switch unit at the position of the fixed terminal. This approach is, however, not practical because the work of assembling and mounting such a key-board switch unit is very troublesome with one or more of the resilient adapter members outwardly applied.

SUMMARY OF THE INVENTION

It is therefore an object of the present invention to provide a novel and improved key-board switch unit of the above described type freed from the problems of the prior art ones, which can be readily assembled with high efficiency but still has a high reliability in the contacting condition between the fixed terminals on the printed circuit board and the contacting circuits on the covering sheet member.

The key-board switch unit of the present invention comprises (a) a printed circuit board having, on one surface thereof, a plurality of fixed contact points, at least one fixed terminal, a plurality of lead-out terminals and wiring circuits interconnecting the fixed contact points, fixed terminals and lead-out terminals with each other, (b) an electrically insulating spacer sheet placed on the printed circuit board and provided with openings at positions corresponding each to one of the fixed contact points and fixed terminals on the printed circuit board, (c) an elastically resilient and electrically insulating covering sheet member placed on the spacer sheet and provided with at least one flexible and electroconductive contacting sheet member formed on the surface thereof facing the spacer sheet, each of the contacting sheet members facing at least one fixed contact point and at least one fixed terminal on the printed circuit board across the openings in the spacer sheet, and (d) at least one screw bolt penetrating the fixed terminal on the printed circuit board and the covering sheet member at the position corresponding to the fixed terminal through an opening in the spacer sheet to fasten together the printed circuit board and the covering sheet member with the spacer sheet sandwiched therebetween in such a manner that each of the contacting sheet members on the covering sheet member is contacted with at least one fixed terminal across an opening in the spacer sheet but a space for key stroke is left between the fixed contact point and the contacting sheet member on the covering sheet member, said space for key stroke being sufficiently narrow so that the contacting sheet member is brought into contact with the fixed contact point across an opening in the spacer sheet when the covering sheet member is pushed at the position corresponding to the opening in the spacer sheet at the fixed contact point.

DETAILED DESCRIPTION OF THE PREFERRED EMBODIMENTS

The key-board switch unit of the invention is now described in detail with reference to the accompanying drawing.

Figure 1A:
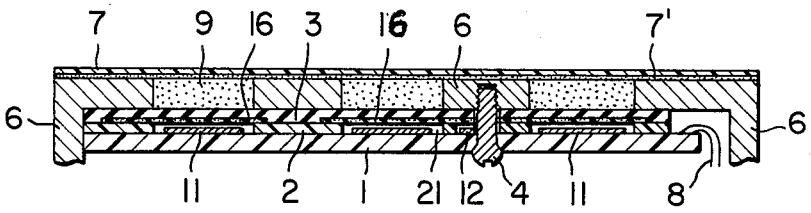
FIG. 1*a* is a cross sectional view of a key-board switch unit of the invention and FIG. 1*b* is an enlargement of a part thereof.
Figure 1B:
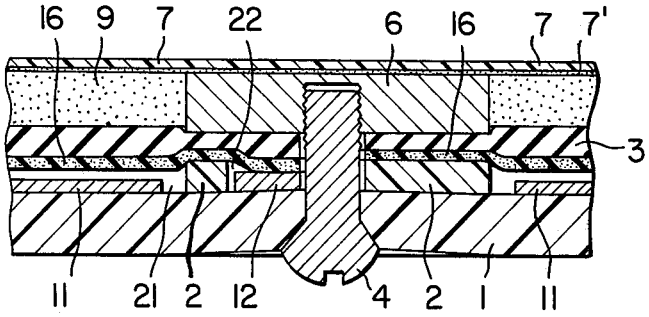
Figure 2:
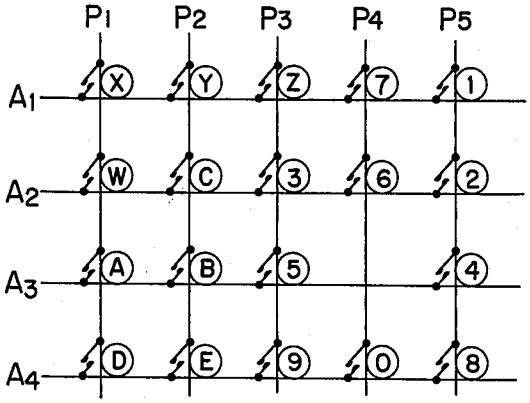
FIG. 2 is a diagram showing the equivalent circuit for the switch unit illustrated in FIGS. 4*a* and 4*b*.
Figure 3:
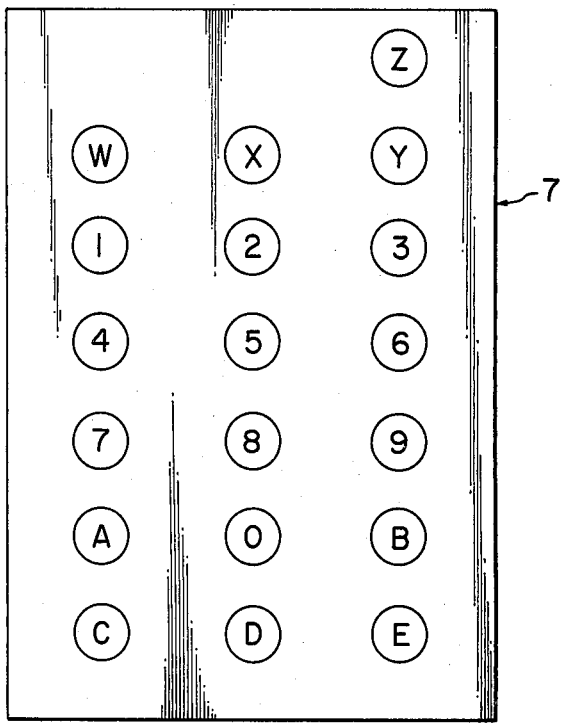
FIG. 3 is a plan view of a switch panel sheet indicating the pushing positions and placed on the covering sheet member.

FIG. 1*a* illustrates a cross sectional view of an example of the inventive key-board switch units as mounted on a frame of an instrument and FIG. 1*b* is an enlargement of a part of the cross section illustrated in FIG. 1*a*. Key-board switch units of this type are used, for example, for the switching operation of a group of switches connected in an X-Y matrix as shown by the circuit diagram of FIG. 2. These switches may usually be operated through a key-board switch panel 7 made of a flexible material as depicted in FIG. 3 of which each of the push switches indicated by one of the numeral figure 0, 1 to 9 or characters A to E and W to Z is used for switching the corresponding switch in the circuit diagram of FIG. 2. The switch panel 7 of FIG. 3 is mounted by bonding with an adhesive agent 7′ on the inventive key-board switch unit illustrated in FIG. 4*a* and FIG. 4*b* as disassembled into the printed circuit board 1 with a spacer sheet 2 (hatched area) placed thereon and the covering sheet member 3 as viewed on the side bearing the contacting sheet members 16, respectively.

The essential components in the inventive key-board switch unit illustrated in these figures are the printed circuit board 1, spacer sheet 2, covering sheet member 3, screw bolts 4 and, optionally, key-board switch panel 7.

Figure 4A:
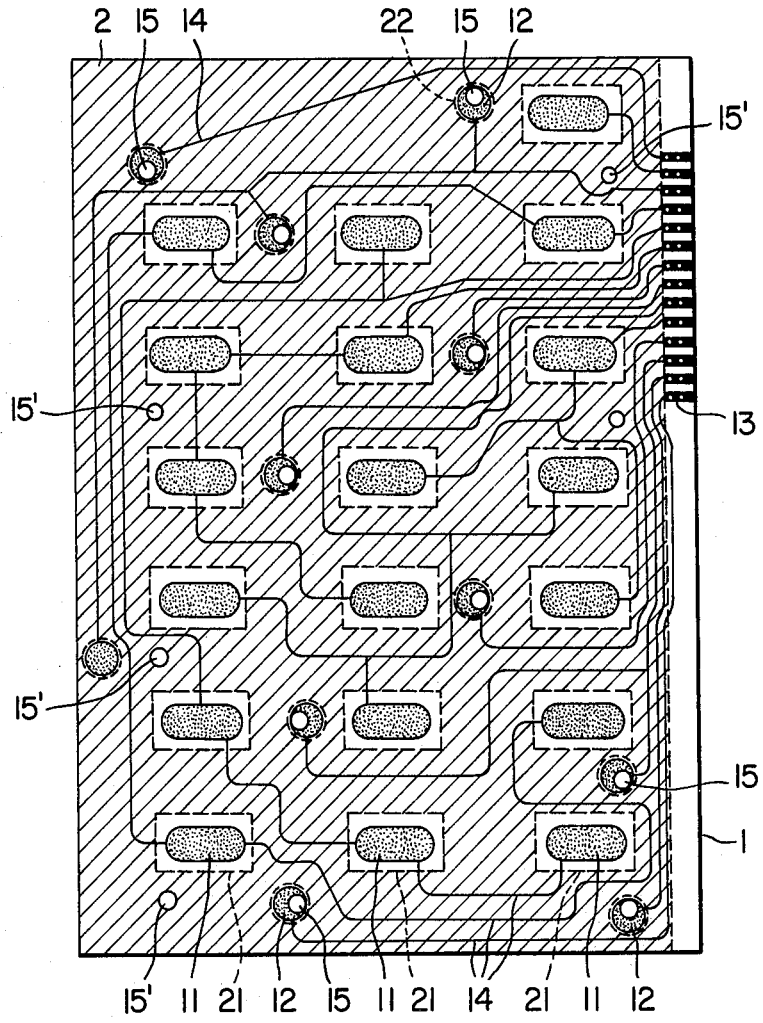
FIGS. 4*a* and 4*b* are plan views of the disassembled key-board switch unit into the printed circuit board (FIG. 4*a*) with the spacer sheet shown by the hatched area and the lower surface of the covering sheet member with the contacting sheet members (FIG. 4*b*).
Figure 4B:
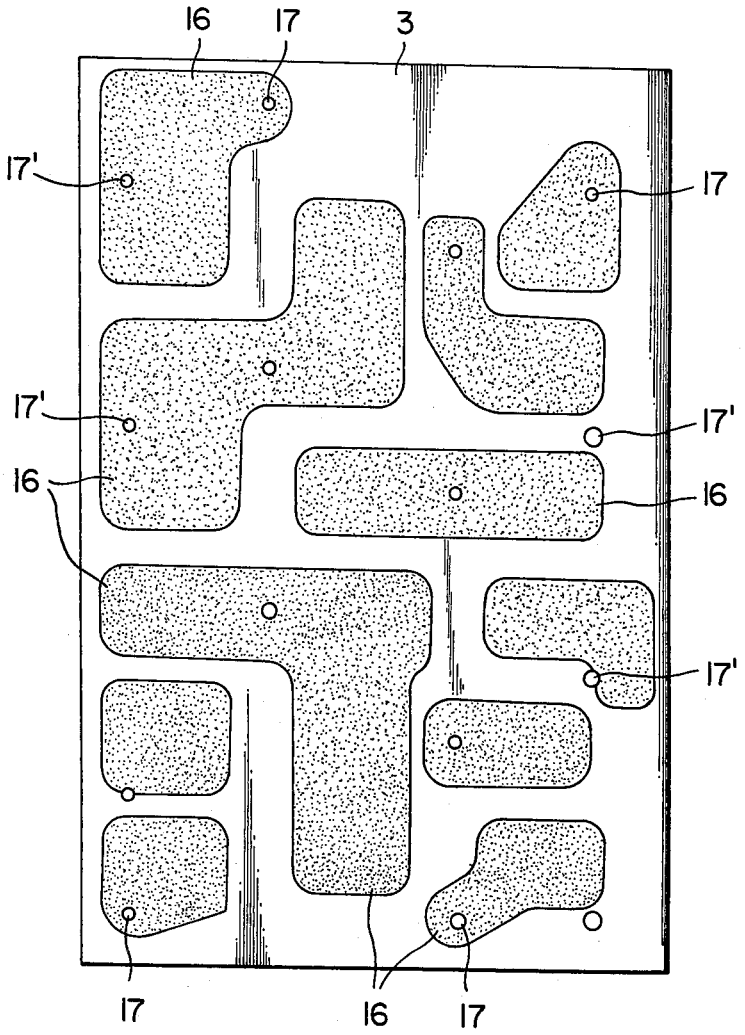

The printed circuit board 1 is, as is well known, made of a relatively rigid, electrically insulating material such as a thermosetting resin, thermoplastic resin or synthetic rubber reinforced with paper, glass fiber and the like although the use of less rigid films or sheets is not excluded if a proper backing means is used. The printed circuit board 1 is provided, on one surface thereof, with a plurality of fixed contact points 11, at least one fixed terminal 12, a plurality of lead-out terminals 13 and connecting circuits 14. Each of the fixed contact points 11 is positioned below one of the push contacts on the switch panel 7 shown in FIG. 3 in the key-board switch unit assembled together. The lead-out terminals 13 are usually positioned at the periphery of the printed circuit board 1 in a parallel arrangement as is shown in FIG. 4*a* and connected to outer circuits by soldering lead wires 8 or by means of an interconnector. There are shown fourteen lead-out terminals 13 which are suitably grouped into nine groups corresponding to the nine terminals $A_1$ to $A_4$ and $P_1$ to $P_5$ in the diagram of the equivalent circuit shown in FIG. 2.

A plan view of the spacer sheet 2 which is to be sandwiched between the printed circuit board 1 and the covering sheet member 3 is shown by the hatched area in FIG. 4*a*. As is shown in this figure, the spacer sheet 2 is provided with a plurality of openings in two groups. The openings of the first group 21 are each at one of the fixed contact points 11 when the spacer sheet 2 is placed on the printed circuit board 1 and are large enough to leave an ample margin around the fixed contact point 11. The openings of the other group 22 are each at one of the fixed terminals 12 on the printed circuit board and, though not limitative, only slightly larger than the fixed terminal 12.

The spacer sheet 2 is usually made of a film or sheet of an electrically insulating synthetic resin. Alternatively, it may be formed by the techniques of printing with an insulating paint or ink to form an insulating layer on the surface of the printed circuit board 1 or on the surface of the mentioned covering sheet member 3 bearing the contacting sheet members 16.

The covering sheet member 3 is usually made of an elastically resilient and electrically insulating material such as synthetic plastics. It is provided, on the surface facing the spacer sheet 2, with a plurality of flexible and electroconductive contacting sheet members 16 bonded thereto and isolated each from the other in a form something like patches. These contacting sheet members 16 may be formed merely by printing with an electroconductive paint or printing ink on the back surface of the covering sheet member 3 or may be formed with an electroconductive rubber sheet by adhesively bonding thereto. Each of the contacting sheet members 16 should be large enough to cover at least one fixed contact point 11 and at least one fixed terminal 12 so that, when the covering sheet member is placed on and fastened together with the printed circuit board 1 with the spacer sheet 2 sandwiched therebetween, one and the same contacting sheet member 16 is simultaneously contacted with at least one fixed terminal 12 and faced by at least one fixed contact point 11 across the opening 22 and 21, respectively, in the spacer sheet 2 with no elaborate means for exact positioning.

The above mentioned fastening of the covering sheet member 3 and the printed circuit board 1 with the spacer sheet 2 sandwiched therebetween is carried out with several screw bolts 4 or equivalent means. The position at which the screw bolt 4 penetrates the printed circuit board 1 and the covering sheet member 3 is essential in this invention. Thus, each of the fixed terminals 12 on the printed circuit board 1 has an opening 15 to be penetrated by the screw bolt 4 as is shown in FIG. 4*a*. Correspondingly, the covering sheet member 3 has openings 17 through the contacting sheet members 16 at positions just facing the openings 15 in the printed circuit board 1. It is of course optional that the printed circuit board 1 and the covering sheet member 3 are provided with one or more of additional openings 15′ or 17′, respectively, for screw bolts in order to increase firmness of fastening together at positions not at the fixed terminals 12.

As is shown in FIGS. 1*a* and 1*b*, it is a convenient way that the printed circuit board 1 and the covering sheet member 3 with the spacer sheet 2 sandwiched therebetween are fastened together to the frame 6 of the instrument with screw bolts 4. The frame or upper board 6 of the instrument has openings filled with a cushioning material 9 at positions above the fixed contact points 11 and covered as a whole with a covering sheet panel 7 indicating the pushing positions as is shown in FIG. 3. When the covering sheet panel 7 is pushed with a finger tip or the like at a pushing position, the pushing force is transmitted through the cushioning material 9 to the covering sheet member 3 and the contacting sheet member 16 at the position becomes contacted with the fixed contacting point 11 on the printed circuit board 1 across the opening 21 in the spacer sheet 2 to close the circuit.

When a screw bolt 4 is screwed more and more tightly to fasten the printed circuit board 1 and the covering sheet member 3, these members 1 and 3 are compressed more around the screw bolt 4 than at the areas remote from the screw bolt 4 as is shown in FIG. 1*b* so that the fixed terminal 12 on the printed circuit board 1 is firmly contacted with the contacting sheet member 16 on the covering sheet member 3 to establish a reliable electric connection therebetween while, on the other hand, a narrow space is left between the fixed contacting point 11 on the printed circuit board 1 and the contacting sheet member 16 on the covering sheet member 3 which serves as a space for key stroke. If necessary to ensure a most suitable key stroke between the fixed contact point 11 on the printed circuit board 1 and the contacting sheet member 16 on the covering sheet member 3, the fixed terminal 12 has a larger thickness than the fixed contact point 11 as is shown in FIG. 1*b*.

Figure 5A:
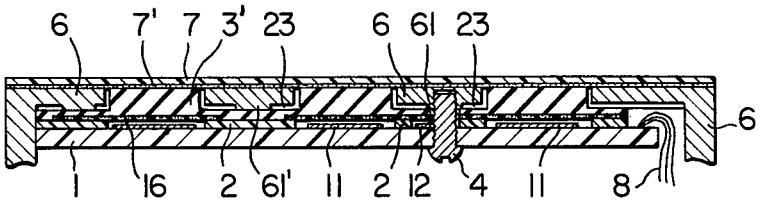
FIGS. 5*a* and 5*b* are each a cross sectional view of an alternative embodiment of the inventive key-board switch unit and FIG. 5*c* is a perspective view of the frame member upside-down.
Figure 5B:
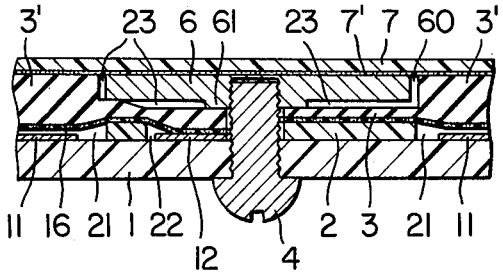

FIG. 5*a* illustrates a cross sectional view of an alternative embodiment of the inventive key-board switch unit and FIG. 5*b* illustrates an enlargement of a part of FIG. 5*a*. The key-board switch unit composed of a printed circuit board 1, a spacer sheet 2 and a covering sheet member 3 is fastened together and fixed to a frame or upper board 6 of the instrument with several screw bolts 4 just in the same manner as in the embodiment shown in FIGS. 1*a* and 1*b*. In this case, however, the upper surface of the covering sheet member 3 is not flat but has raised projections 3' entering the openings 60 in the frame 6 shown in FIG. 5*c* upside-down with the surface thereof being coplanar with the upper surface of the frame 6. A switch panel 7 is bonded to the upper surfaces of the frame 6 and the covering sheet member 3 with an adhesive agent 7'.

Figure 5C:
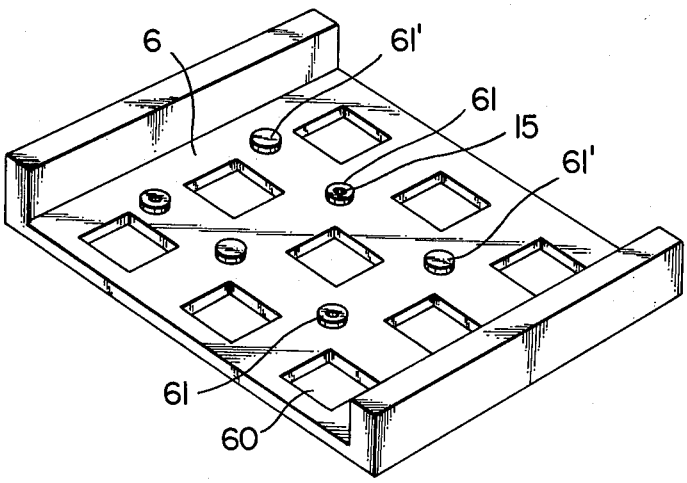

As is shown in FIG. 5*c*, the frame 6 is provided on the lower surface thereof with several stud-like protrusions 61, 61'. The protrusions 61 at the positions of the fixed terminals 12 have each an opening 15 to be penetrated by a screw bolt 4 while the other protrusions 61' are not. By virtue of these protrusions 61 and 61', air passages 23 are formed between the covering sheet member 3 and the lower surface of the switch panel 7 and the frame 6 when the key-board switch unit is fastened to the frame 6 with the screw bolts 4. When no such air passages are formed as in the embodiment shown in FIGS. 1*a* and 1*b*, there may be sometimes formed void spaces or thickened portions of the adhesive layer 7' below the switch panel 7 due to the distortion of the printed circuit board 1 and/or covering sheet member 3 as the fastening force by the screw bolts 4 is increased leading to frequent bulging in the interface between the covering sheet member 3 and the switch panel 7 as a consequence of the changes in the environmental conditions in the temperature and humidity eventually resulting in an accidental short-circuiting.

Figure 6A:
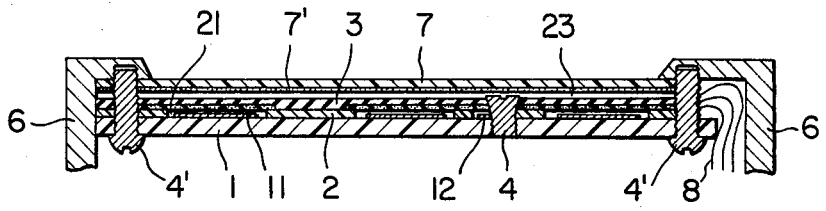
FIGS. 6*a* and 6*b* are each a cross sectional view of a further alternative embodiment of the inventive key-board switch unit and FIG. 6*c* is a perspective view of a part of the covering sheet member.
Figure 6B:
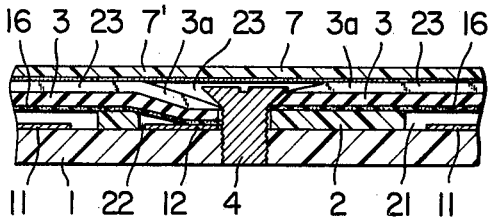
Figure 6C:
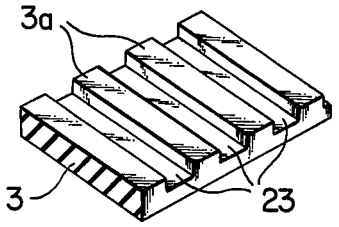

FIGS. 6*a*, 6*b* and 6*c* illustrate a further alternative embodiment of the inventive key-board switch unit. FIG. 6*a* is a cross sectional view of the switch unit and FIG. 6*b* is an enlargement of a part thereof. As is shown in FIG. 6*a*, the key-board switch unit is mounted on the frame 6 with several screw bolts 4' separately from the screw bolts 4 fastening the printed circuit board 1, spacer sheet 2 and covering sheet member 3 since the frame 6 has no upperboard portions. Instead of having stud-like projections 61 and 61' in FIG. 5*c*, the covering sheet member 3 is provided with parallel ridges 3*a* on the upper surface thereof as is shown in FIG. 6*c* illustrating a perspective view of a part of the covering sheet member 3 so that the panel sheet 7 is bonded with an adhesive agent 7' to the top surfaces of the parallel ridges 3*a* leaving the spaces 23 between the ridges 3*a* which serve as the air passages.

The provision of the air passages 23 between the switch panel 7 and the covering sheet member 3 is very effective when the performance of the inventive key-board switch unit is desired to be more reliable and durable.

What is claimed is:

1. A key-board switch unit which comprises (a) a printed circuit board having, on one surface thereof, a plurality of fixed contact points, fixed terminals, a plurality of lead-out terminals and wiring circuits interconnecting the fixed contact points, fixed terminals and lead-out terminals with each other, (b) an electrically insulating spacer sheet placed on the printed circuit board and provided with openings at positions corresponding each to one of the fixed contact points and fixed terminals on the printed circuit board, (c) an elastically resilient and electrically insulating covering sheet member placed on the spacer sheet and provided with flexible and electroconductive contacting sheet members formed on the surface thereof facing the spacer sheet, each of the contacting sheet members facing at least one fixed contact point and at least one fixed terminal on the printed circuit board across the openings in the spacer sheet, and (d) at least one screw bolt penetrating the fixed terminal on the printed circuit board and the covering sheet member at the position corresponding to the fixed terminal through an opening in the spacer sheet to fasten together the printed circuit board and the covering sheet member with the spacer sheet sandwiched therebetween in such a manner that each of the contacting sheet members on the covering sheet member is contacted with at least one fixed terminal across an opening in the spacer sheet but a space for key stroke is left between the fixed contact point and the contacting sheet member on the covering sheet member, said space for key stroke being sufficiently narrow so that the contacting sheet member is brought into contact with the fixed contact point across an opening in the spacer sheet when the covering sheet member is pushed at the position corresponding to the opening in the spacer sheet at the fixed contact point.

2. A key-board switch unit which comprises (a) a printed circuit board having, on one surface thereof, a plurality of fixed contact points, fixed terminals, a plurality of lead-out terminals and wiring circuits interconneting the fixed contact points, fixed terminals and lead-out terminals with each other (b) an electrically insulating spacer sheet placed on the printed circuit board and provided with openings at positions corresponding each to one of the fixed contact points and fixed terminals on the printed circuit board, (c) an elastically resilient and electrically insulating covering sheet member placed on the spacer sheet and provided with flexible and electroconductive contacting sheet members formed on the surface thereof facing the spacer sheet, each of the contacting sheet members facing at least one fixed contact point and at least one fixed terminal on the printed circuit board across the openings in the spacer sheet, (d) a switch panel sheet placed on the covering sheet member and adhesively bonded thereto and having an indication of a pushing position on the surface corresponding to each of the fixed contact points on the printed circuit board, and (d) at least one screw bolt penetrating the fixed terminal on the printed circuit board and the covering sheet member at the position corresponding to the fixed terminal through an opening in the spacer sheet to fasten together the printed circuit board and the covering sheet member with the spacer sheet sandwiched therebetween in such a manner that each of the contacting sheet members on the covering sheet member is contacted with at least one fixed terminal across an opening in the spacer sheet but a space for key stroke is left between the fixed contact point and the contacting sheet member on the covering sheet member, said space for key stroke being sufficiently narrow so that the contacting sheet member is brought into contact with the fixed contact point across an opening in the spacer sheet when the covering sheet member is pushed at the position corresponding to the opening in the spacer sheet at the fixed contact point.

3. The key-board switch unit as claimed in claim 2 wherein an air passage is formed between the covering sheet member and the switch panel sheet.

* * * * *